United States Patent [19]

Christenson et al.

[11] 4,099,984

[45] Jul. 11, 1978

[54] PROCESS FOR CLEANING FOULED HEAT EXCHANGERS

[75] Inventors: Christopher P. Christenson; Gary M. McNamee, both of Lake Jackson, Tex.

[73] Assignee: The Dow Chemical Company, Midland, Mich.

[21] Appl. No.: 793,328

[22] Filed: May 3, 1977

[51] Int. Cl.[2] ..... B08B 3/08

[52] U.S. Cl. ..... 134/2; 134/22 R; 134/42; 252/87

[58] Field of Search ..... 134/2, 22 R, 42; 252/87, 172; 165/5, 95; 122/401; 208/48 R, 48 AA, 262; 260/679 A, 681.5 C, 438.1; 55/71, 72, 96, 242

[56] References Cited

U.S. PATENT DOCUMENTS

| | | | |
|---|---|---|---|
| 3,651,159 | 3/1972 | Long et al. | 60/438.1 X |
| 3,857,869 | 12/1974 | Turnbo | 260/438.1 |

*Primary Examiner*—S. Leon Bashore
*Assistant Examiner*—Marc L. Caroff
*Attorney, Agent, or Firm*—James G. Carter

[57] ABSTRACT

Heat exchangers which become fouled during cooling of $CuAlCl_4$·solvent (such as toluene) solutions employed in extracting carbon monoxide from acetylene is cleaned by circulating through the fouled exchanger a solvent solution of $CuAlCl_4$·solvent containing aluminum trichloride.

3 Claims, 1 Drawing Figure

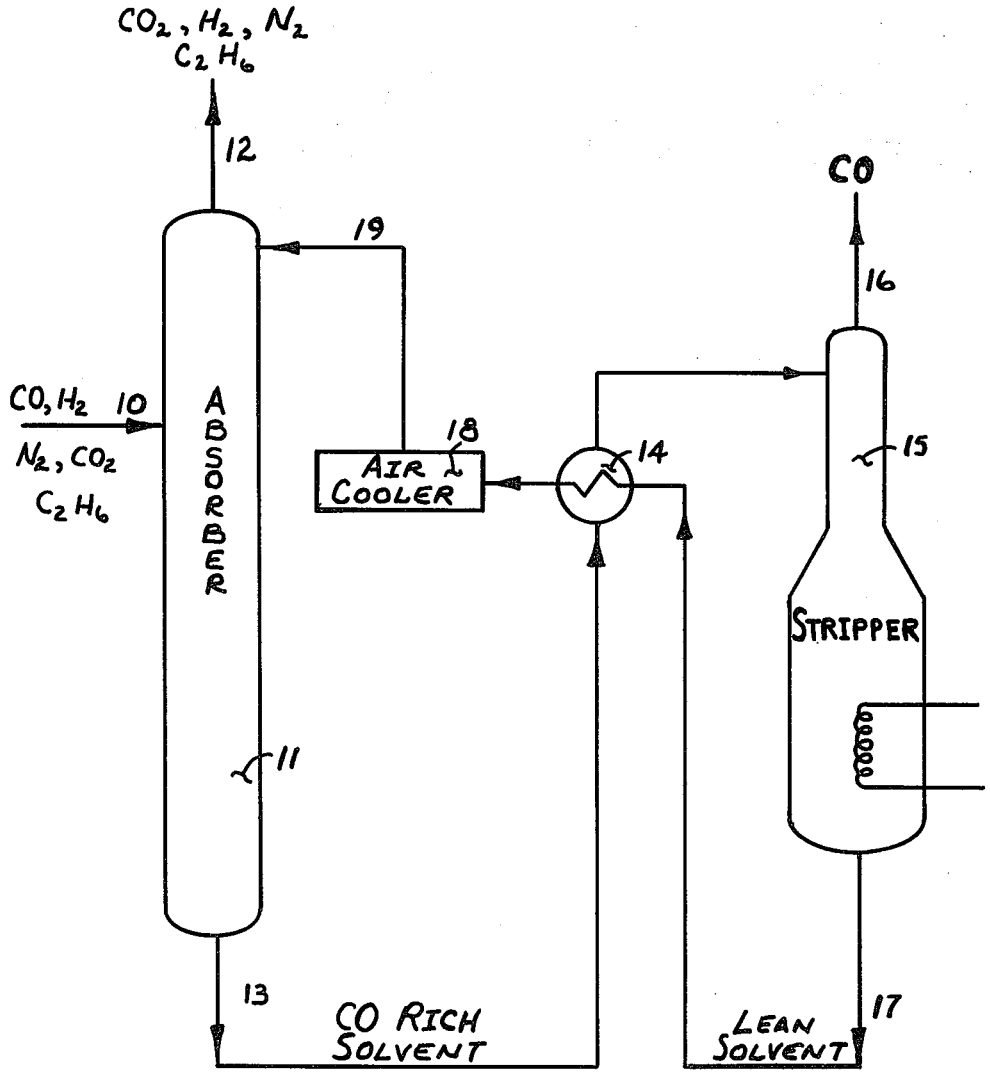
$CO_2$, $H_2$, $N_2$
$C_2H_6$
12
19
CO
16
$CO, H_2$ 10
$N_2$, $CO_2$
$C_2H_6$
ABSORBER
18
AIR COOLER
14
15
STRIPPER
11
13
CO RICH SOLVENT
LEAN SOLVENT
17

PROCESS FOR CLEANING FOULED HEAT EXCHANGERS

SUMMARY OF THE INVENTION

The present invention is directed to a process for cleaning heat exchangers which become fouled during the extraction of carbon monoxide or hydrocarbons from mixed gaseous streams containing same with a solvent solution of $CuAlX_4$. solvent.

BACKGROUND OF THE INVENTION

The use of cuprous aluminum halide ($CuAlX_4$) as a complexing agent in recovering carbon monoxide, aliphatic or aromatic hydrocarbons from gaseous streams containing same have been described in U.S. Pat. Nos. 3,592,865; 3,647,843; 3,651,159; 3,754,047 and 3,755,487.

In processes which employ cuprous aluminum halide.solvent sorbent solutions to extract carbon monoxide or aliphatic or aromatic hydrocarbons from streams containing same there is a tendency, particularly when the solution of complexing agent becomes contaminated with water, for a black "gunky" scale to form on the walls of the heat exchanger. This ultimately causes a loss in efficiency of the heat exchanger, i.e. a drop or decrease in the temperature differential, $\Delta T$, between the outlet and inlet of the exchanger. Heretofore, this scale or "gunky" material (a mixture of tars and cuprous halide) has been removed by hydroblasting, e.g., contacting with water or steam under high pressure. Such is undesirable because care must be exercised to remove the residual water before placing the exchanger back in service. The process of the present invention represents an improvement over the hydroblasting method for the following reasons: (1) maintenance costs are reduced, (2) less exposure of maintenance personnel to the sorption agent, (3) less down time since this method is faster than hydroblasting and (4) there is no solvent degradation due to residual water which could result from hydroblasting.

Some of the above noted disadvantages to the hydroblasting can be solved by the present invention.

BRIEF DESCRIPTION OF THE DRAWING

The drawing is a schematic showing the removal of carbon monoxide from a gaseous stream containing CO, $H_2$, $N_2$, $CO_2$ and $C_2H_6$ by contacting with a sorption fluid consisting of a toluene solution of $CuAlCl_4$.toluene.

DETAILED DESCRIPTION OF THE INVENTION

In the process of the present invention heat exchangers which become fouled as a result of passing therethrough a sorption fluid containing a solvent solution of cuprous aluminum tetrahalide ($cuAlX_4$).solvent are cleaned by circulating through the heat exchanger a solvent solution of $CuAlX_4$.solvent containing $AlX_3$ wherein X is chlorine, bromine, fluorine or iodine such that the fouled portion thereof is contacted with the solution.

While it is not known the exact mechanism by which the fouling is removed, it is believed to be due to a chemical reaction between the aluminum trihalide and the cuprous halide to form cuprous aluminum tetrahalide.solvent according to the reaction $$CuCl + AlX_3 \xrightarrow{solvent} CuAlX_4.\text{solvent}$$

which tends to loosen the "gunky" material and permit it to be carried away and which can subsequently be removed from the solvent containing the complexing agent $CuAlX_4$. solvent by filtration, centrifugation, decantation or other known methods.

In the drawing, a gaseous stream containing CO, $N_2$, $H_2$, $CO_2$ and $C_2H_2$ is fed via line 10 into an absorber 11 wherein said stream is counter currently contacted with a toluene solution of $CuAlCl_4$.toluene as a sorbent or complexing agent. A stream containing CO rich solvent is removed from the absorber 11 via line 13 wherein it passes through a crossexchanger 14 into stripper 15 wherein the CO is removed via line 16. The lean toluene solution containing the complexing or sorption agent, $CuAlCl_4$.toluene, is removed from stripper 15 via line 17 through crossexchanger 14 into an air cooler 18 containing a plurality of finned tubes and from there via line 19 into absorber 11 thus completing the cycle. Pumps, flow controllers, and other equipment are obviously not shown.

The sorbent solvent solution to which the aluminum halide is added can contain from about 20% to about 80%, preferably from about 40% to about 70% of $CuAlX_4$.solvent complex by weight.

The amount of aluminum halide which can be added to the sorbent solvent solution can be from about 1% to about 15% preferably from about 8% to about 10% by weight based upon the combined weight of aluminum halide plus sorbent solvent solution.

In practicing the present invention, the sorbent solution containing the $AlX_3$ can be circulated through the fouled heat exchanger at temperatures of from about 0° C to about 50° C preferably from about 20° C to about 40° C for a time sufficient to reduce the amount of fouling to the extent possible, i.e., further treatment would no longer remove any additional quantities of fouling, or the fouling is removed to the extent desired.

The higher the temperature the less time is required to remove a like quantity of fouling from the exchanger or more fouling can be removed for a like period of time of treatment.

The following examples are illustrative of the invention but are not to be construed as to limiting the scope thereof in any manner.

EXAMPLE 1

One of the finned tubes from the air cooler 18 shown in the drawing measuring approximately 1-inch by 12-inches which had become fouled during operation of the CO extraction process was cleaned by circulating through the tube at a rate of about 1 gallon per minute of a toluene solution of $CuAlCl_4$.toluene containing 10% $AlCl_3$ by weight, said toluene solution containing 10% $CuAlCl_4$. toluene by weight of solution. After 20 hours, visual inspection of the tube indicated the removal of essentially all of the fouling from the tube.

EXAMPLE 2

During one operation of the process shown in the drawing, after cleaning the air cooler 18 by hydroblasting, the inlet and outlet temperatures were 90° C and 40° C respectively. When the outlet temperature had reached 74° C, a solution containing 600 lbs of $AlCl_3$ in 10,037.65 lbs of a toluene solution of $CuAlCl_4$.toluene (containing 0.65 lb of $CuAlCl_4$.toluene per lb of solution) was circulated through the air cooler at ambient temperature (about 23° C) for 96 hours. When the air cooler was placed back into operation, the inlet and outlet temperatures were 90° C and 51° C respectively.

The above example indicates that approximately 67% of the fouling had been removed calculated on the temperature differential as follows:

outlet temperature of cooler before fouling: 40° C
outlet temperature of fouled cooler: 74° C
outlet temperature of cooler after cleaning by method of this invention: 51° C $$\text{\% fouling removed} = \frac{\text{temp. after fouling-temp. after cleaning}}{\text{temp. after fouling-temp. before fouling}} \times 100$$

$$= \frac{75 - 51}{74 - 40} \times 100$$

$$= \frac{23}{34} \times 100$$

$$= 67.65$$

We claim:

1. In a process for removing fouling from heat exchangers wherein the fouling is generated by passing a sorbent solvent solution containing $CuAlX_4$. solvent complex through said heat exchangers; the improvement which comprises removing said fouling by contacting the portion of said exchanger containing said fouling with a sorbent solvent solution containing from about 1 to about 15% $AlX_3$ by weight and from about 20% to about 80% by weight of $CuAlX_4$. solvent complex wherein in each instance X is a halogen.

2. the process of claim 1 wherein the process is conducted at a temperature of from about 0° C to about 50° C, X is chlorine and the solvent is toluene.

3. The process of claim 2 wherein the temperature is from about 20° C to about 40° C and the sorbent solvent solution contains about 8% to about 10% $AlCl_3$ by weight and about 40% to about 70% $CuAlCl_4$.solvent complex by weight.

* * * * *